US006723974B1

(12) United States Patent
Sepp

(10) Patent No.: US 6,723,974 B1
(45) Date of Patent: Apr. 20, 2004

(54) PROCESS FOR THE ADAPTIVE BEAM CONTROL OF MEDIUM-ENERGY LASER WEAPONS

(75) Inventor: Gunther Sepp, Feldafind (DE)

(73) Assignee: LFK Lenkflugkörpersysteme GmbH, München (DE)

( * ) Notice: Subject to any disclaimer, the term of this patent is extended or adjusted under 35 U.S.C. 154(b) by 572 days.

(21) Appl. No.: 09/246,004

(22) Filed: Feb. 10, 1999

(30) Foreign Application Priority Data

Feb. 6, 1998 (DE) ..... 198 04 720

(51) Int. Cl.[7] ..... G01J 1/20; B64D 1/04; H01S 3/10

(52) U.S. Cl. ..... 250/201.9; 89/1.11; 372/9; 372/33

(58) Field of Search ..... 250/201.9; 372/9, 372/33; 89/1.11

(56) References Cited

U.S. PATENT DOCUMENTS 3,720,213 A * 3/1973 Hobart et al.
3,946,233 A * 3/1976 Erben et al.
4,271,355 A * 6/1981 Wisner et al.

OTHER PUBLICATIONS

G. Sepp, R. Protz Sep. 19–20, 1995, "Zweites deutsch–französisches Kolloquium über Hubschrauberbekä mpfung".
Frederick G. Gebhardt Jun. 1976, High Power laser propagation Applied Optics, vol. 15, No. 6.
C.L. Hayes et al, Applied Optics, vol. 18, No. 24, p. 4106, Dec. 15, 1979.*
J. Wallace et al, J. Opt. Soc. Am., vol. 67, No. 11, p. 1569, Nov. 1977.*

* cited by examiner

*Primary Examiner*—Stephen C. Buczinski
(74) *Attorney, Agent, or Firm*—McGlew and Tuttle, P.C.

(57) ABSTRACT

A process for the adaptive beam control of medium-energy laser weapons for fighting electro-optical sensors and windows, wherein the behavior of the laser power reflected from a bright spot of the target and measured by a thermal image apparatus during increasing irradiation intensity is analyzed during a phase of measurement. The laser power to be emitted that will lead to the desired laser beam diameter or to the highest possible laser intensity at the target during the subsequent phase of fighting is then derived by calculation from this as well as other parameters influencing the thermal beam expansion. It is thus made possible that the laser does not always have to be operated with the maximum power, but only with the currently needed power during the phase of fighting, so that a saving is achieved in the consumption of primary laser energy. One example is explained.

5 Claims, 3 Drawing Sheets

PROCESS FOR THE ADAPTIVE BEAM CONTROL OF MEDIUM-ENERGY LASER WEAPONS

FIELD OF THE INVENTION

The present invention pertains to a process for the adaptive beam power control of medium-energy laser weapons for fighting electro-optical sensors and windows, wherein a medium-energy laser, a control device with a heat image apparatus, a computer and a laser power controller are associated with the medium-energy laser weapon.

BACKGROUND OF THE INVENTION

Medium-energy laser weapons are used against electro-optical sensors and against windows, e.g., of combat helicopters. Such a weapon has become known, e.g., under the name MELAS and is described, e.g., in the article "Medium-energy laser weapon MELAS against helicopter and airplane cockpits and electro-optical sensors, G. Sepp, R. Protz, 2nd German-French Colloquium on Fighting Helicopters, ISL, Saint-Louis, F, Sep. 19–20, 1995, Conference Proceedings. When using such weapons, a surface of small diameter in the case of electro-optical sensors and a surface of large diameter in the case of windows must usually be irradiated with a sufficiently high intensity and for a sufficiently long period of time in order to make the sensor unable to function or to make the window non-transparent. However, the laser power to be emitted for this purpose—and subsequently the irradiation time, which it also determines—can be determined accurately only if the known effect of the thermal beam expansion of a medium-energy laser ("thermal blooming"), i.e., the thermal expansion caused by the absorption-related heating of the propagation channel, is sufficiently taken into account quantitatively. The theory of "thermal blooming" was described, e.g., in the article "F. G. Gebhard, High power laser propagation, *Appl. Opt.*, 15, 1479 (1976). For lack of a suitable method for including this problem in the fighting procedure, the laser weapons have hitherto been equipped with a control device for the beam intensity, which only sets a maximum laser beam power at all times or at least such a high laser beam power that it is certainly sufficient for the desired fighting effect at the given distance from the target. However, if the laser is usually operated with the maximum power or, for safety reasons, with a power that is actually much too high, more primary energy (e.g., chemical fuel burned in the laser combustion chamber in the case of a gas-dynamic laser) is consumed than would be actually necessary for the desired fighting effect.

There is yet another drawback in addition to this drawback of the prior-art control devices. When the weapon is used against (small-surface) sensors, this method may even lead to an undesired reduction in the fighting effect, because, due to the above-mentioned "thermal blooming," the laser intensity reaching the sensor is lower at the emitted laser power that is actually too high than it would be at a lower emitted laser power.

SUMMARY AND OBJECTS OF THE INVENTION

The primary object of the present invention is to provide a process of the type described in the introduction, in which no such "safety margin" is necessary for the emitted laser power any more, so that the lowest possible primary energy consumption is necessary for the desired effect of the laser weapon at the target. In addition, it shall be possible to set the emitted laser power that leads to the maximum attainable laser intensity in the center of the beam at the target. Finally, it shall also be possible to set such an emitted laser power that, taking the expansion ofthe beam of the medium-energy laser due to "thermal blooming" into account, the desired laser beam diameter suitable for fighting the selected target will be obtained at the target.

According to the invention, a process for the adaptive beam control of medium-energy laser weapons is provided for fighting electro-optical sensors and windows. A medium-energy laser, a control device with a heat image apparatus, a computer and a laser power controller are associated with the medium-energy laser weapon. To set the desired laser beam diameter at the target during a measuring phase, the said laser beam of the said medium-energy laser is directed toward the target with an initially lower emitted laser beam power. Subsequently, the computer of the control device progressively increases the beam power up to the maximum possible beam power ($L_{max}$) by means of the laser power controller. The laser power ($L_G(t)$) that is reflected by the bright spot of the target and measured by the heat image apparatus is recorded by the computer. The computer determines the maximum ($L_{G,max}$) of the laser power from this. During a phase of calculation, the computer calculates the critical laser power ($L_c$), the critical laser intensity ($I_C$), the laser beam diameter (D (t)) at the target, and the maximum ($L_{G,max}(t_c)$) of the reflected laser power ($L_g(t)$) measured by the heat image apparatus (13), using the influential parameters which determine the thermal beam expansion and which have been fed into the computer. During a phase of fighting, the computer sets the emitted laser power (L) such that the desired laser beam diameter (D) will be obtained at the target by means of the laser power controller, using the results obtained during the phase of calculation.

The computer may set the critical laser power ($L_c$) on said medium-energy laser during the phase of fighting.

The various features of novelty which characterize the invention are pointed out with particularity in the claims annexed to and forming a part of this disclosure. For a better understanding ofthe invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
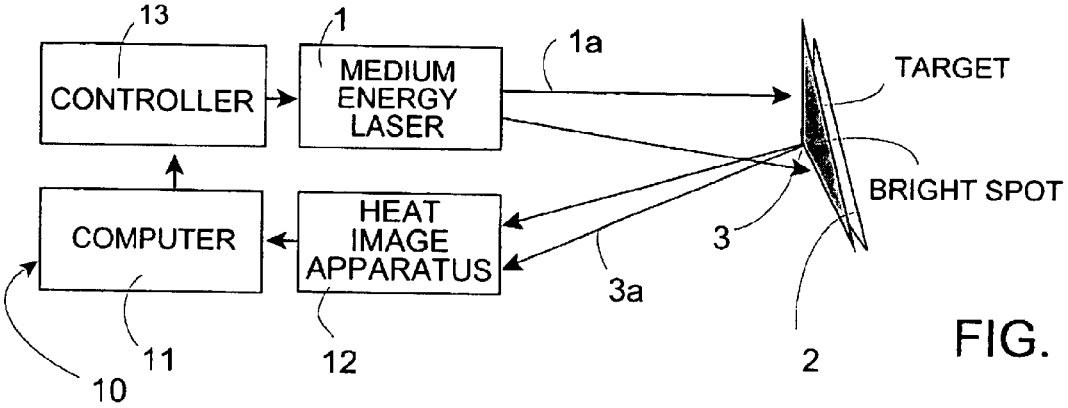
FIG. 1 is a schematic diagram to illustrate the arrangement of the components of the process according to the present invention during the fighting procedure.
Figure 2:
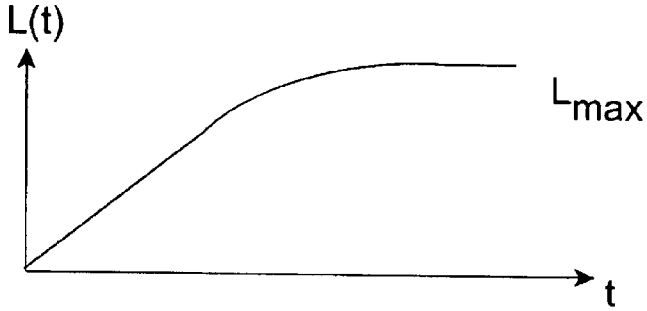
FIG. 2 is a time diagram of the laser power L (t) (in W) emitted during the phase of measurement.

Referring to the drawings in particular, to set the desired focal spot diameter D of a medium-energy laser weapon on the target, the control device 10 according to the present invention first carries out a measuring procedure during a phase of measurement to determine the effect of "thermal blooming." To do so, the laser beam 1*a* of the medium-energy laser 1 (MEL) (which is focused corresponding to the distance from the target and the size of the sensor or window to be fought) is directed toward the target 2. A computer 11, which is associated with the control device 10 and controls the entire procedure, sets an initially low laser power L by means of a laser power controller 13 arranged downstream of it. The laser power $L_G$ that is reflected from a bright spot 3 of the target 2 located as close to the desired target point (sensor, window) as possible to the medium-energy laser weapon is now measured with a heat image apparatus 12 associated with the control device 10 (FIG. 1). Since such a bright spot 3 acts as a punctiform light source, the power $L_G$ measured by the thermal image apparatus 12 is proportional to the laser intensity I reaching the target 2. The computer 11 then progressively increases the laser beam power L (t) to the beam power $L_{max}$ that is the maximum possible power with the medium-energy laser 1 (FIG. 2) by, e.g., the mass flow rate of the fuel through the medium-energy laser 1 being correspondingly increased. The laser power $L_G$ (t) is continued to be measured in this process as well (FIG. 3) and is stored in the computer 11 for the subsequent evaluation.

Figure 4:
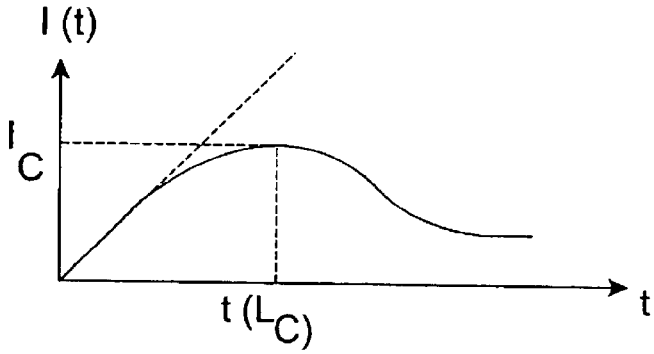
FIG. 4 is a time diagram of the laser intensity I (t) at the target (in W/cm$^2$), which is calculated during the phase of calculation.
Figure 5:
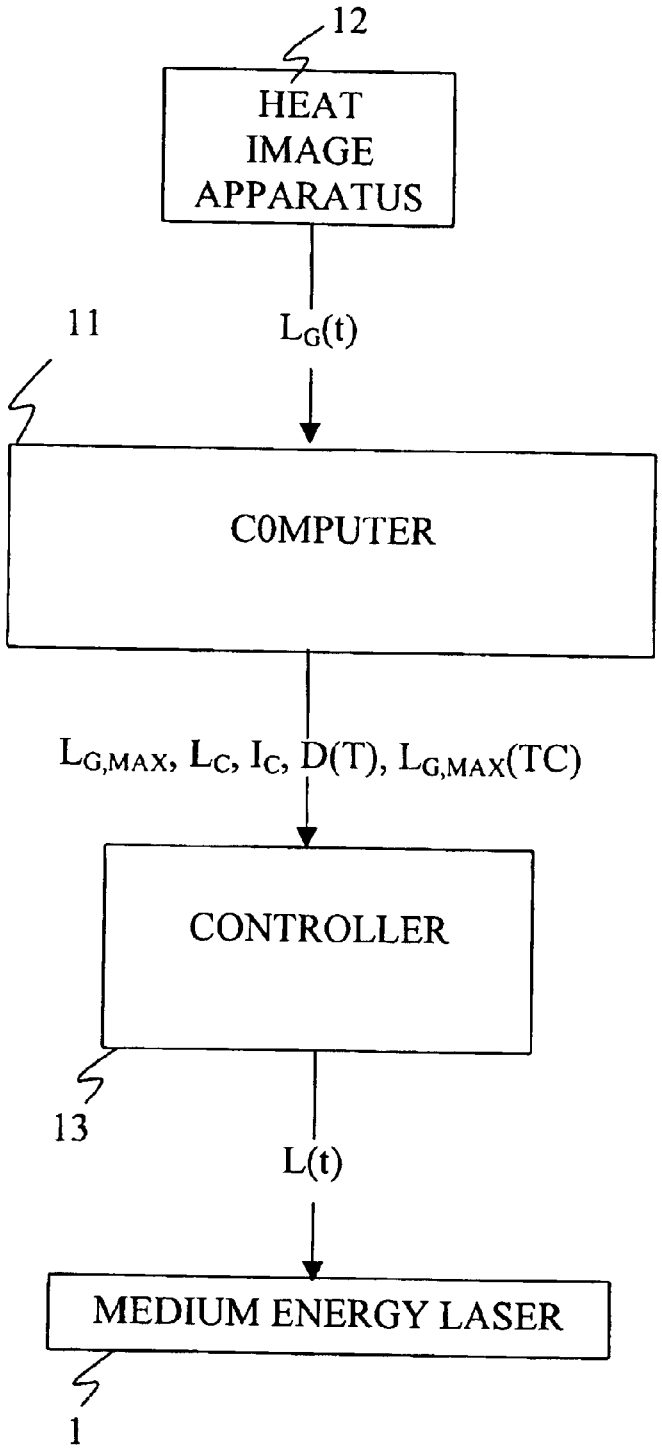
FIG. 5 is a block diagram of the calculation steps performed over time on the emitted laser information and the reflected heat image to determine laser beam diameter.
Figure 6:
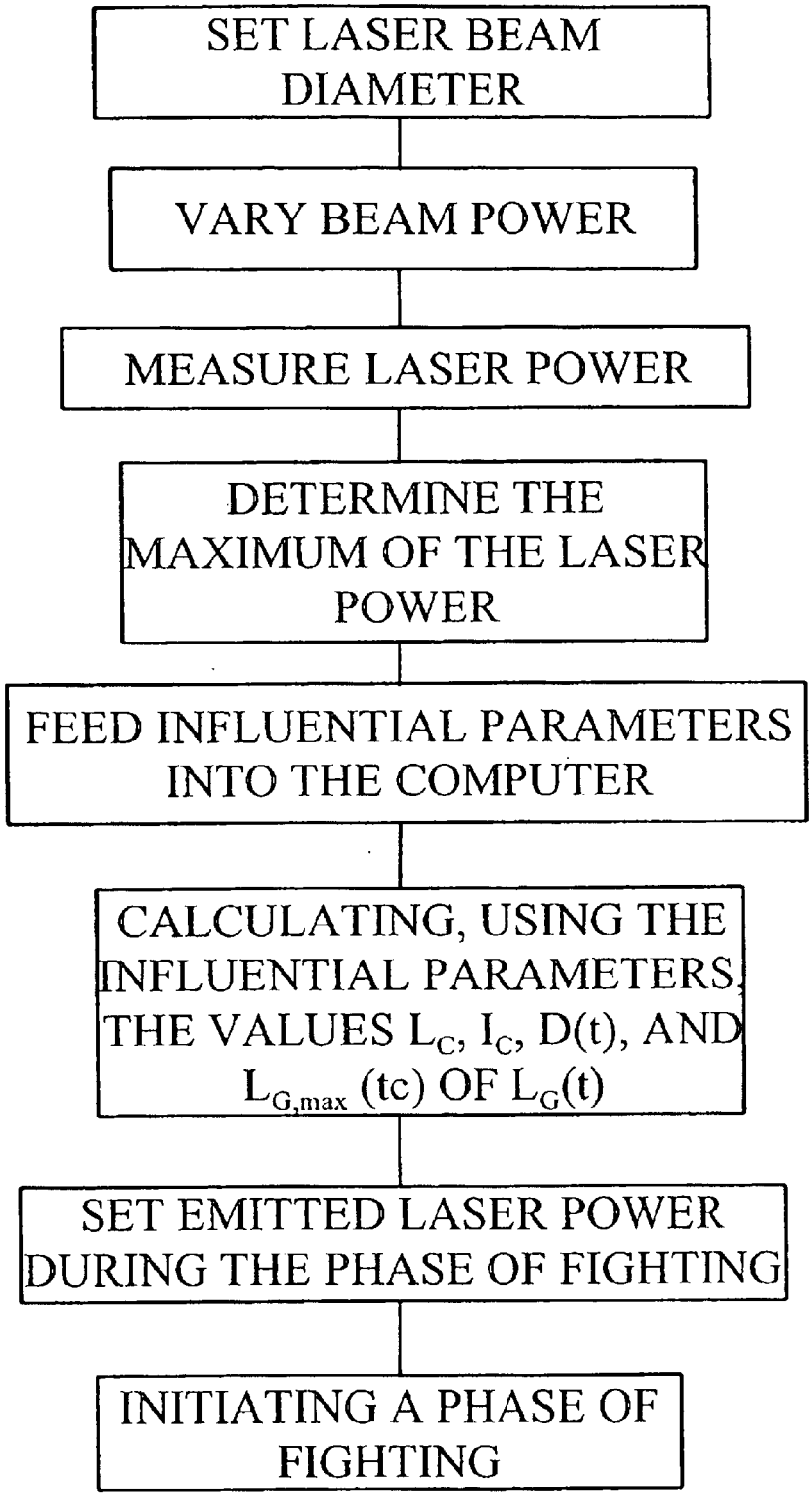
FIG. 6 is a flow chart of the present invention.

This phase of measurement is now followed by a phase of calculation. The known theory of "thermal blooming" describes how an increasingly under-proportionally increasing laser intensity I (t) is obtained at the target 2 because of the beam expansion due to the heating of the propagation channel at higher emitted laser power L (t) until the so-called critical laser intensity I (t)=$I_c$, which is the maximum possible laser intensity at the target 2, is reached at the so-called critical emitted laser power L (t)=$L_c$. When the emitted laser power L (t) is increased further, the laser intensity I (t) at the target 2 even decreases as a consequence of the intensely increasing "thermal blooming" (FIG. 4).

Figure 3:
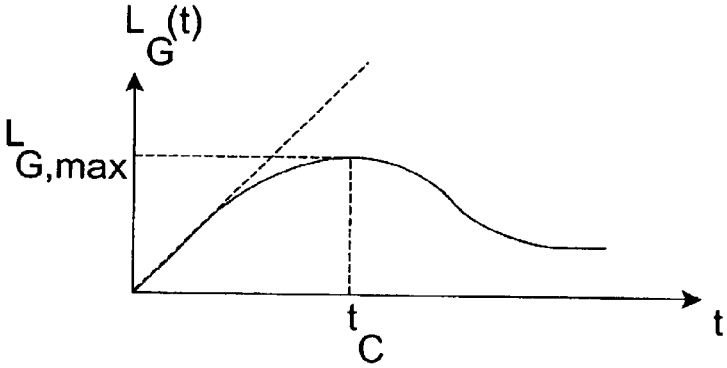
FIG. 3 is a time diagram of the laser power $L_G(t)$ (in W) reflected in the process by a bright spot of the target to the thermal image apparatus.

As a consequence of this, the reflected laser power $L_G$ measured with the thermal image apparatus (TIA) 12 also increases increasingly under-proportionally with increasing emitted laser power L (t), reaching a corresponding maximum $I_{G,max}(t_c)$ at the time t=$t_c$ and then decreases again, as is shown in FIG. 3.

The theory of "thermal blooming" makes it possible to calculate the critical laser power $L_c$, the critical laser intensity I (t)=$I_c$, and the resulting focal spot or laser beam diameter D (t) of the laser beam 1*a* of a medium-energy laser 1 on the target 2 and consequently also the corresponding maximum $L_{G,max}$ ($t_c$), for which it needs the values of certain influential parameters. The most important of these are the properties of the atmosphere (absorption and extinction of the laser beam, wind, turbulence, etc.), the system parameters of the medium-energy laser weapon used (laser power, transmitting aperture, laser beam quality, etc.) and the given conditions of use (distance from the target, beam movement resulting from the tracking of the laser beam in the case of a moving target, etc.).

This calculation is now carried out in the computer 11, and the influential parameters are measured, estimated or determined in another way and are fed into the computer 11. As a result of this calculation, the laser intensity I (t) at the target 2 as well as the corresponding laser beam diameter D (t) as a function of the emitted laser power L (t) are known.

Using these results, the computer 11 of the control device 10, which is thus an adaptive control device, finally sets the emitted power L during the subsequent phase of fighting such that the desired beam diameter D is obtained at the target 2 at the distance from the target. As was mentioned above, this is a surface of a small diameter (e.g., 0.15 m) in the case of electro-optical sensors and a surface of large diameter (e.g., 0.5 m) in the case of windows.

When using the process described for medium-energy laser weapons, it is recommended to make the transmitting aperture only as large as necessary for focusing on the smallest desired beam diameter D (in the case of the fighting of sensors) at the nominal fighting range of the weapons system and without regard to the beam expansion due to "thermal blooming." The laser power necessary for fighting the sensor, but at most the critical laser power L (t)=$L_c$, which leads, as was explained, to the maximum attainable laser intensity I (t)=I; at the target 2, is then set during the phase of fighting.

To set larger beam diameters D (when fighting windows), the described thermal blooming effect is then intentionally used, the rule being, as was said, that the higher the laser power, the greater the beam expansion.

These measures have led to a process for the adaptive beam control of medium-energy laser weapons which makes it possible to accurately set the diameter D of the laser beam 1*a* on the target 2 and thus to bring the laser energy accurately onto the needed target surface without going beyond this surface, as a result of which the amount of primary laser energy needed for the fighting procedure is minimized.

While a specific embodiment of the invention has been shown and described in detail to illustrate the application of the principles of the invention, it will be understood that the invention may be embodied otherwise without departing from such principles.

What is claimed is:

1. A process for adaptive beam control of medium-energy laser weapons for fighting electro-optical sensors and windows, wherein a medium-energy laser, a control device with a heat image apparatus, a computer and a laser power controller are associated with the medium-energy laser weapon, wherein the process sets a desired laser beam diameter (D) at the targets the process comprising the steps of:

during a measuring phase, directing the laser beam of the medium-energy laser toward the target with an initially lower emitted laser beam power (L(t)), after which the computer of the control device progressively increases the beam power (L(t)) up to a maximum possible beam power ($L_{max}$) by means of the laser power controller, wherein the laser power ($L_G$(t)) that is reflected as a bright spot off the target and measured by the heat image apparatus is recorded by the computer and wherein the computer determines the maximum ($L_{G,max}$) of the laser power from the measured bright spot;

during a phase of calculation, calculating with the computer the critical laser power ($L_c$), the critical laser intensity ($I_C$), the laser beam diameter (D (t)) at the target, and the maximum ($L_{G,max}(t_c)$) of the reflected laser power ($L_g$(t)) measured by the heat image apparatus using influential parameters which determine thermal beam expansion and which have been fed into the computer; and during a phase of fighting, setting with the computer the emitted laser power (L) such that the desired laser beam diameter (D) will be obtained at the target by means of the laser power controller, using the results obtained during the phase of calculation.

2. The process in accordance with claim 1, wherein said computer sets the critical laser power ($L_c$) on the medium-energy laser during the phase of fighting.

3. A process for adaptive beam control of medium-energy laser weapons for fighting electro-optical sensors and windows, the process comprising:

providing a medium-energy laser, a control device with a heat image apparatus, a computers and a laser power controller associated with the medium-energy laser weapon;

setting a desired laser beam diameter at a target including directing the laser beam of the medium-energy laser toward the target, varying the beam power (L(t)), measuring the laser power ($L_G(t)$) that is reflected as a bright spot off the target with the heat image apparatus, determining a maximum ($L_{G,max}$) of the laser power from the measured bright spot, and calculating with the computer the critical laser power ($L_c$), the critical laser intensity ($I_C$), the laser beam diameter (D (t)) at the target, and the maximum ($L_{G,max}(t_c)$) of the reflected laser power ($L_g(t)$) measured by the heat image apparatus using influential parameters which determine thermal beam expansion and which have been fed into the computer.

4. The process in accordance with claim 3, further comprising during a phase of fighting, setting with the computer the emitted laser power (L) such that the desired laser beam diameter (D) will be obtained at the target by means of the laser power controller, using the results obtained during the step of calculating.

5. The process in accordance with claim 4, wherein said computer sets the critical laser power ($L_c$) on the medium-energy laser during the phase of fighting.

* * * * *